US007314018B2

(12) United States Patent
Ager

(10) Patent No.: US 7,314,018 B2
(45) Date of Patent: Jan. 1, 2008

(54) COLLAPSIBLE BOAT HULL

(75) Inventor: Gavin R. Ager, Bibra Lake (AU)

(73) Assignee: QuickBoats Pty Ltd. (AU)

( * ) Notice: Subject to any disclaimer, the term of this patent is extended or adjusted under 35 U.S.C. 154(b) by 0 days.

(21) Appl. No.: 11/282,218

(22) Filed: Nov. 17, 2005

(65) Prior Publication Data

US 2007/0034136 A1 Feb. 15, 2007

(30) Foreign Application Priority Data

Aug. 11, 2005 (CA) ..... 2515812
Aug. 12, 2005 (AU) ..... 2005203597

(51) Int. Cl.
*B63B 7/00* (2006.01)

(52) U.S. Cl. ..... 114/354

(58) Field of Classification Search ..... 114/343, 114/352, 353, 354, 357, 364
See application file for complete search history.

(56) References Cited

U.S. PATENT DOCUMENTS 2,346,081 A * 4/1944 Randrup ..... 114/354
2,504,225 A * 4/1950 Randrup ..... 114/354
2,880,429 A * 4/1959 Henry ..... 114/354
3,482,368 A 12/1969 Stansbury, Jr.
3,639,933 A 2/1972 Trowbridge
4,282,616 A * 8/1981 Battershill ..... 114/354
4,911,095 A * 3/1990 Kaye ..... 114/354
5,372,085 A * 12/1994 Kaye ..... 114/352
5,488,922 A * 2/1996 Hinderberger ..... 114/354
5,524,570 A * 6/1996 Kaye ..... 114/353

FOREIGN PATENT DOCUMENTS

| | | |
|---|---|---|
| AU | 2004904559 | 8/2004 |
| EP | 0 425 728 A1 | 5/1991 |
| GB | 942270 | 11/1963 |
| GB | 2013586 A | 8/1979 |
| NZ | 213536 | 9/1985 |
| WO | WO 90/03914 A1 | 4/1990 |

* cited by examiner

*Primary Examiner*—Lars A. Olson
(74) *Attorney, Agent, or Firm*—Bachman & LaPointe, P.C.

(57) ABSTRACT

A collapsible boat hull comprises a pair of bottom panels and a pair of side panels, connected by continuous hinges. Erection of the boat causes a fore portion of the bottom panels to curve upwards, and fore portions of the side panels to curve inwards. The boat also includes a V-shaped rear seat, which acts to transfer force and vibration from a rearwardly mounted outboard motor to the side walls of the boat.

25 Claims, 6 Drawing Sheets

COLLAPSIBLE BOAT HULL

BACKGROUND OF THE INVENTION

The present invention relates to a collapsible boat hull which can be readily collapsed for ease of transportation and readily erected for use.

It is known to provide collapsible boat hulls, comprising a pair of hingedly interconnected bottom panels and a pair of side panels hinged to the bottom panels. Such boats can be collapsed and folded along the hinging edges of the panels into a substantially flat configuration. Typically collapsible boat hulls are also provided with a stem member functioning as a transom, a bow member, and seats which are mounted onto the boat hull when the boat hull is in an erected configuration. It is important that the junction between the boat hull and the bow member, and the boat hull and the stem member, are leak-proof. Provision is generally also made to mount an outboard motor on the stem member.

Some collapsible boat hulls are provided with rigid stem members, while others are provided with diaphragms that can accommodate rigid panels, which rigidify and stabilise the diaphragm when an outboard motor is mounted thereon. The stress exerted on the boat hull by the outboard motor mounted on the stem members, however, has meant that it has not previously been possible to use outboard motors whose power exceeds about four horsepower.

Further, the collapsible boat hulls of the prior art, when arranged in their erected configuration, are generally flexible rather than rigid, leading to poor handling in the water.

The present invention attempts to overcome at least in part some of the aforementioned disadvantages.

SUMMARY OF THE INVENTION

In accordance with a first aspect of the present invention there is provided a collapsible boat hull comprising: a pair of bottom panels, each bottom panel having a first continuous hinge along an inner edge thereof and a second continuous hinge along an outer edge thereof; and a pair of side panels, each side panel being connected to an adjacent bottom panel along a respective second continuous hinge; wherein the first and second continuous hinges each have spines, the spines having resilient flexibility along respective longitudinal and transverse planes thereof, thereby facilitating the bottom and side panels to be moved between a folded configuration and an erected configuration. Advantageously this allows the boat hull to move from a substantially flat configuration when folded to form an conventional shape when erected.

In accordance with a second aspect of the present invention there is provided A collapsible boat hull comprising: a pair of bottom panels, each bottom panel having a first continuous hinge along an inner edge thereof and a second continuous hinge along an outer edge thereof; a pair of side panels, each side panel being connected to an adjacent bottom panel along a respective second continuous hinge; a stem member; and a seat, the seat providing a brace between the stem member and the side panels. Preferably, the seat is V-shaped. Advantageously, this permits force and vibration from an outboard motor mounted on the stem member to be transmitted to the side panels.

In accordance with a third aspect of the present invention, there is provided a method of erecting a collapsible boat, the method including the steps of providing a boat comprising a pair of bottom panels, each bottom panel having a first continuous hinge along an inner edge thereof and a second continuous hinge along an outer edge thereof, and a pair of side panels, each side panel being connected to an adjacent bottom panel along a respective second continuous hinge; providing a separating member, the separating member comprising two pins arranged to locate in apertures of the side panels, the two pins being arranged to move apart upon the application of a force; locating the pins in the apertures; and applying a force to the separating member to cause the two side panels to move away from each other.

DESCRIPTION OF THE DRAWINGS

The present invention will now be described, by way of example, with reference to the accompanying drawings, in which.

DETAILED DESCRIPTION OF AN EMBODIMENT OF THE INVENTION

Figure 1:
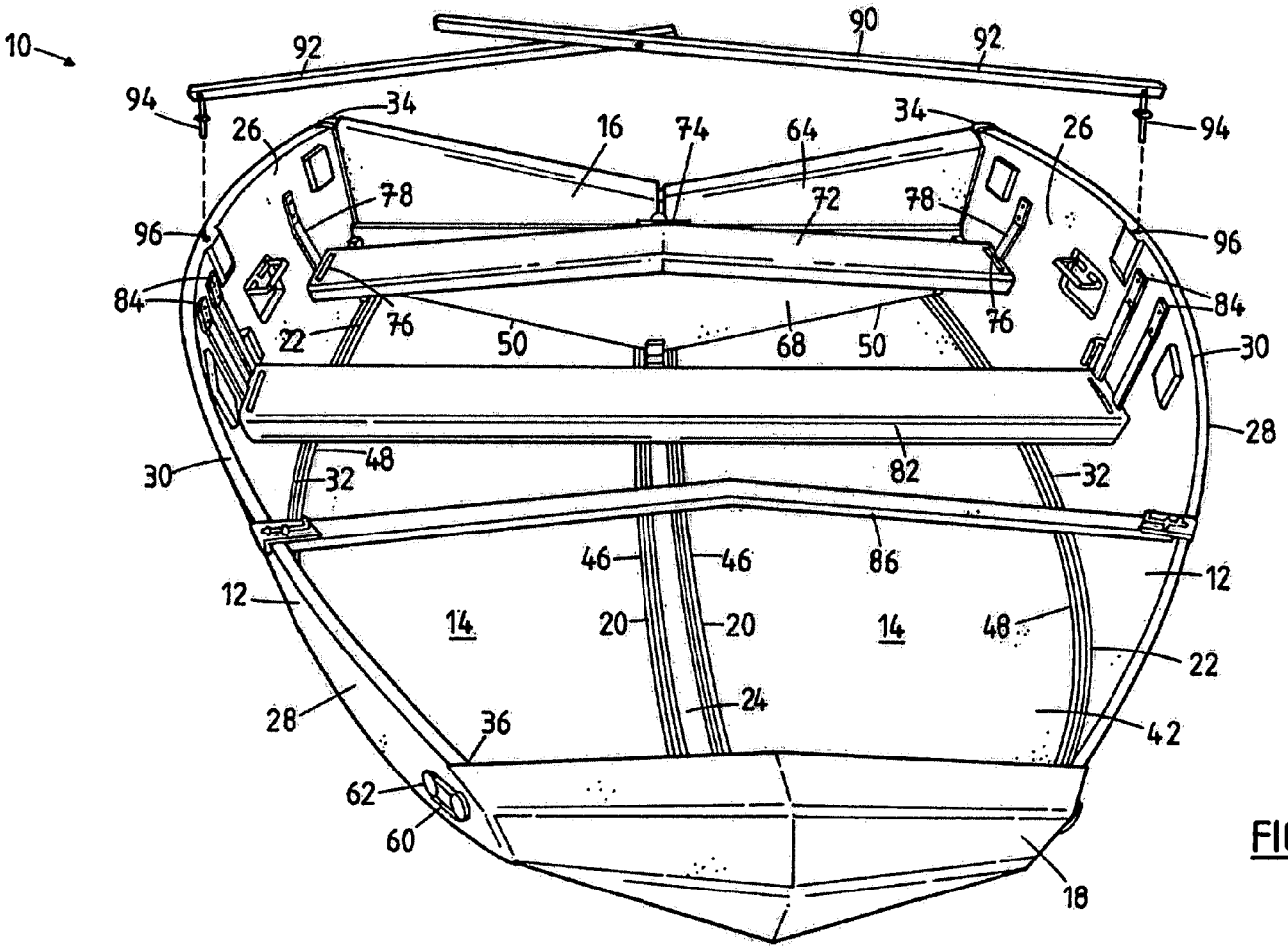
FIG. 1 is an upper perspective view of a collapsible boat hull in accordance with the present invention, shown in an erected configuration.

Referring to the Figures, there is shown a collapsible boat hull 10 comprising a pair of side panels 12, a pair of bottom panels 14, a stem member 16, and a bow member 18. Each bottom panel 14 has a first continuous hinge 20 along an inner edge thereof, and an second continuous hinge 22 along an outer edge thereof. In the embodiment of the drawings, each of the first continuous hinges 20 is connected to respective first and second sides of a centrally disposed keel member 24. In an alternative keel-less embodiment of the invention, the two bottom panels 14 are connected along a single common first continuous hinge 20.

Figure 2:
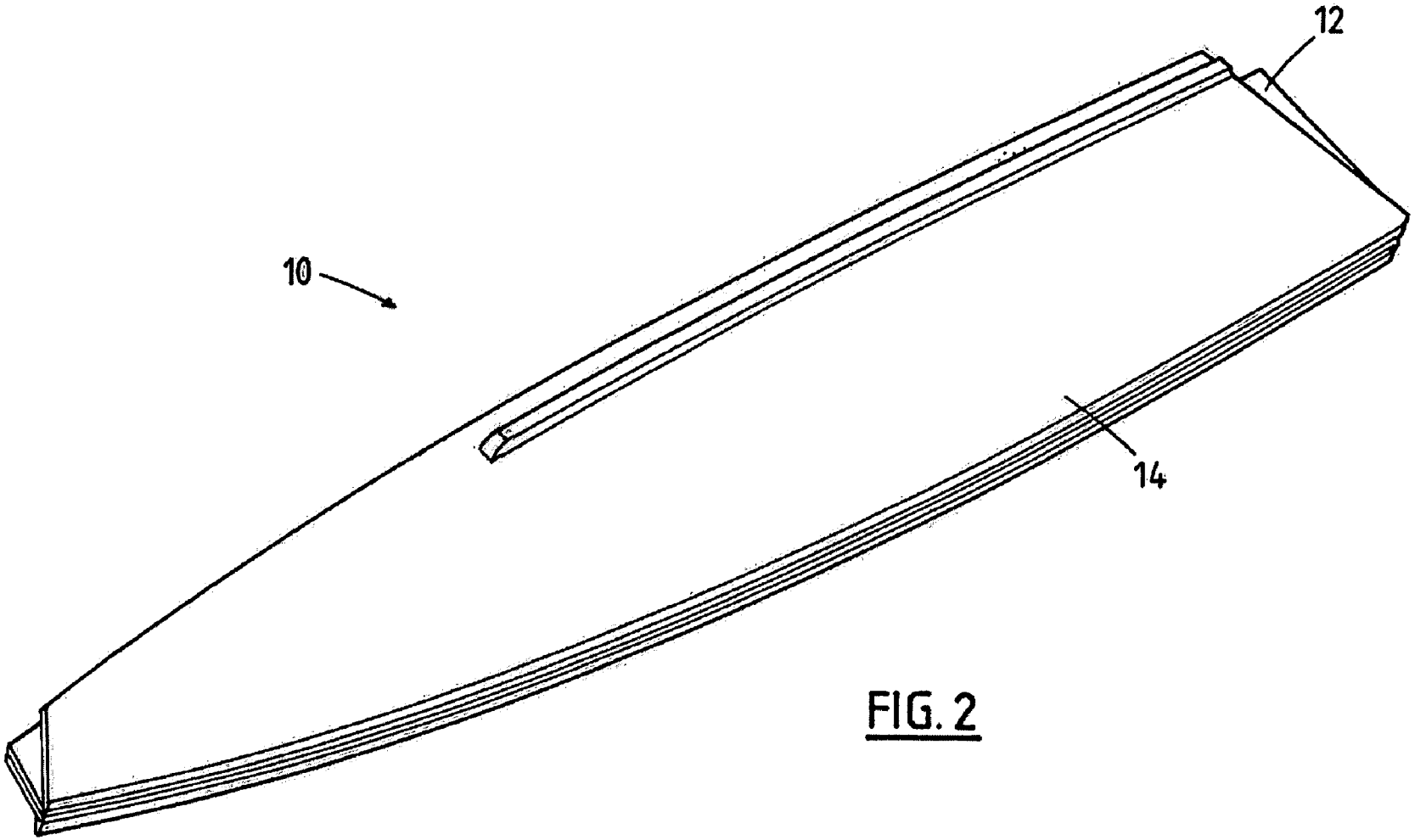
FIG. 2 is a side view of the collapsible boat hull of FIG. 1, shown in a collapsed and folded configuration.
Figure 3:
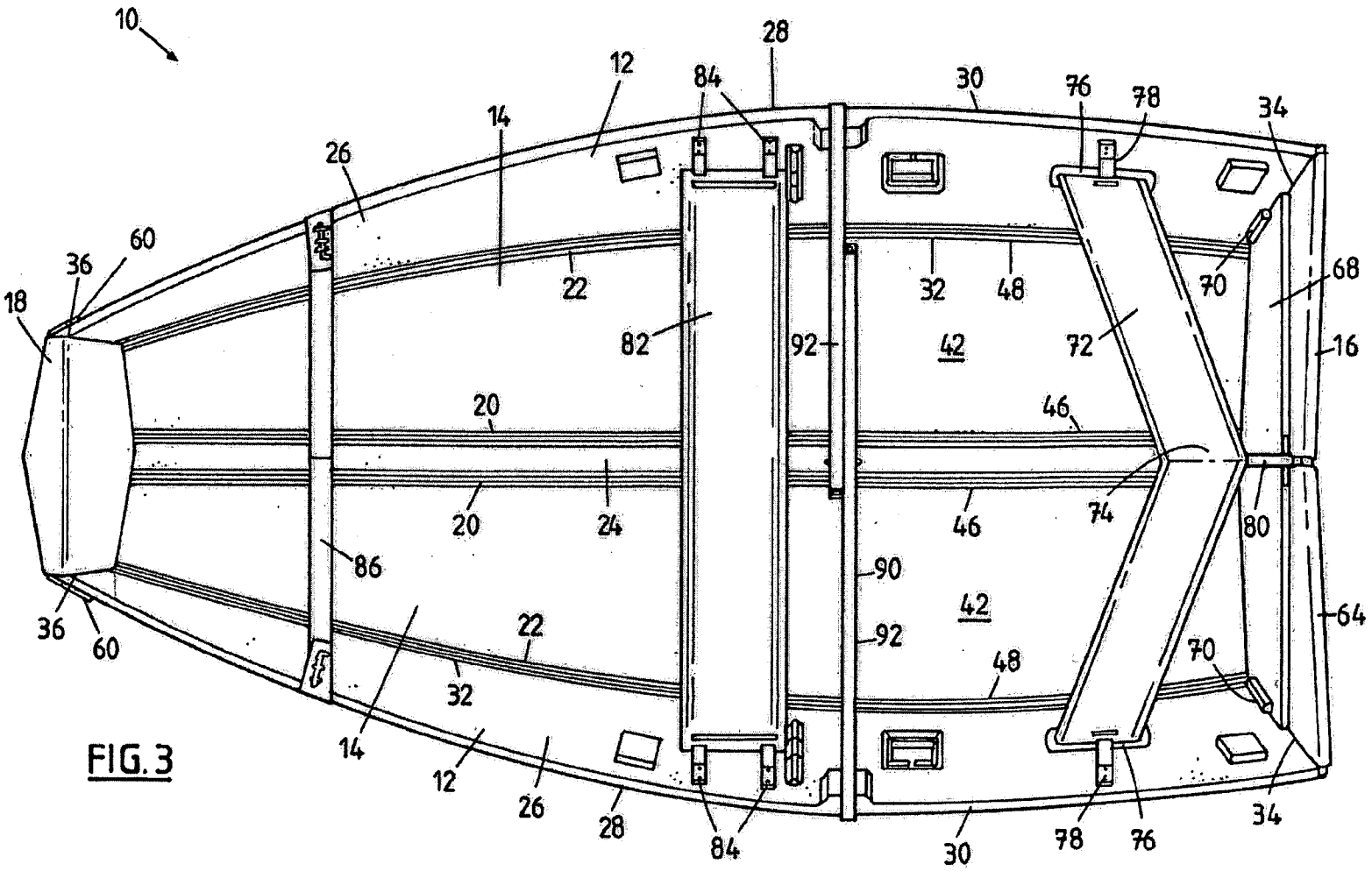
FIG. 3 is a top plan view of the collapsible boat hull of FIG. 1.

Each bottom panel 14 is connected to a corresponding side panel 12 along its second continuous hinge member 22. Spines of each of the first and second continuous hinge members 20, 22 have resilient flexibility along respective longitudinal and transverse planes thereof, thereby facilitating the bottom and side panels 14, 12 to be collapsed and folded from a first position wherein the boat hull 10 is in an erected configuration shown in FIG. 1 to a second position wherein the boat hull 10 is in a collapsed and folded state as shown in FIG. 2.

The side and bottom panels 12, 14 are made from stiff, lightweight materials that have high tensile strength and resist abrasion. Typically, the side and bottom panels 12, 14 are made from a composite fibreglass material. Alternatively, the side and bottom panels 12, 14 man be made from a marine grade aluminium honeycomb closed cell composite panel of approximately ten mm width, such as a 5052 HR Al composite panel, or a heavy duty alternative such as aramid (e.g., Kevlar® fiber) and polypropylene. These may be a combination of composite or honeycomb structures. Preferably, the rigidity of the material is such that when the boat hull 10 is in the erected configuration, the boat hull 10 is almost rigid and rides very well in the water. Further, the side and bottom panels 12, 14 could also be made from a rigid and/or composite aluminium, plywood or plastics materials, with high tensile strength and abrasion resistivity.

The keel member 24 is substantially flat and elongate. It is arranged to be longitudinally aligned along the keel line of the boat hull 10. The keel member 24 may be made from any suitable rigid or semi-rigid material including metal, plastics or wood having sufficient flexibility from a mid-ship line 1 (see FIG. 7) forward to the aft of the boat hull 10 to form a compound curve toward the bow increasing its curvature and tension to partly form a unique bow shape while the boat hull 10 is being erected.

Figure 7:
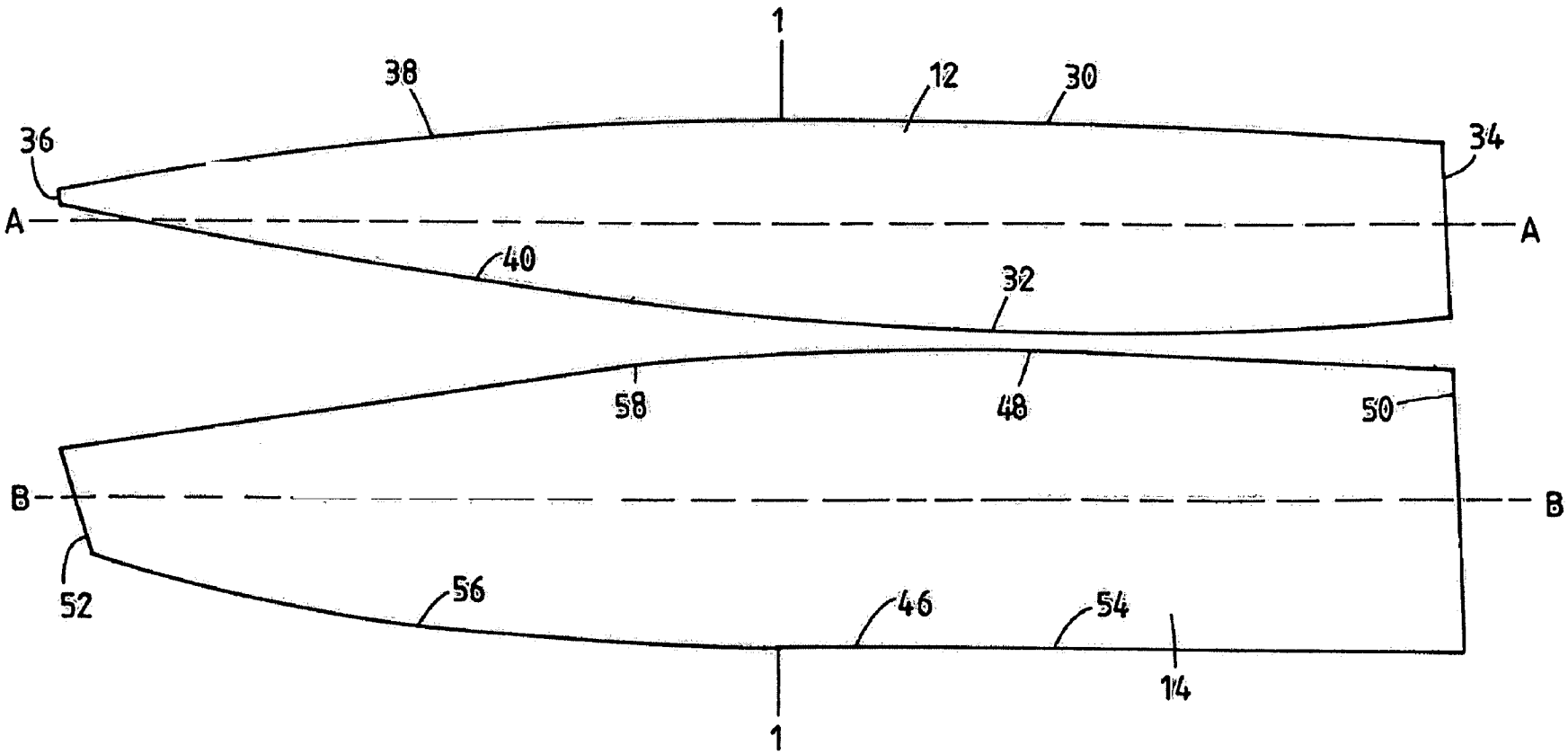
FIG. 7 is an exploded diagrammatic view of a side panel and a bottom panel of the collapsible boat hull of FIG. 1.

Each side panel 12, shown in isolation in FIG. 7, is substantially flat and elongate having an inner surface 26, an outer surface 28, a gunwale edge 30, an inner edge 32, an aft edge 34, and a fore edge 36. The gunwale edge 30 of the side panel 12 is shaped to define a first continuous convex curve 38 descending from the aft edge 34 to the fore edge 36, as shown in FIG. 7. A descent of the first continuous convex curve 38 becomes steeper from about the mid-ship line 1 towards the fore edge 36.

The inner edge 32 of the side panel 12 is shaped to define a second continuous convex curve 40 descending from the aft edge 34 to the fore edge 36, as shown in FIG. 7. A descent of the second continuous convex curve 40 becomes steeper from about the mid-ship line 1 towards the fore edge 36. The descent of the second continuous convex curve 40 is greater than the descent of the first continuous convex curve 38 such that the side panel 12 is asymmetrically disposed about a central longitudinal plane A-A of the side panel 12. Accordingly, the fore edge 36 is shorter in length than the aft edge 34, and the fore side edge 36 is disposed asymmetrically about the central longitudinal plane A-A towards to the gunwale edge 30.

Typically the aft edge 34 is disposed at substantially right angles to the gunwale edge 30 and the inner edge 32. However, the angle may vary by as much as ±20°. The aft edge 34 is substantially symmetrically disposed about the central longitudinal plane A-A of the side panel 12. The depth of the side panel 12 may be varied from the gunwale edge 30.

Each bottom panel 14, shown in isolation in FIG. 7, is substantially flat and elongate having an inner surface 42, an outer surface 44, an inner edge 46, an outer edge 48, an aft edge 50, and a fore edge 52.

The inner edge 46 of the bottom panel 14 is shaped to define a substantially straight longitudinally disposed portion 54 between the aft edge 50 and about the mid-ship line 1, and a third continuous convex curve 56 descending from about the mid-ship line 1 to the fore edge 52, as shown in FIG. 7.

The outer edge 48 of the bottom panel 14 is shaped to define a fourth continuous convex curve 58 which flares outwardly from the aft edge 50, reaching its maximum outward extent at a point rearwardly disposed of the mid-ship line 1, then descends from about the mid-ship line 1 to the fore edge 52, as shown in FIG. 7. The difference in shapes of the inner edge 46 and outer edge 48 mean that the bottom panel 14 is asymmetrically disposed about a central longitudinal plane B-B of the bottom panel 14.

Accordingly, the fore edge 52 is shorter in length than the aft edge 50. Typically the fore edge 52 is rearwardly inclined from the outer edge 48 by about 20°, although this may vary by ±20°.

Typically the aft edge 50 is disposed at substantially right angles to the inner edge 46 and the outer edge 48. The aft edge 50 is substantially symmetrically disposed about the central longitudinal plane B-B of the bottom panel 14. The width of the bottom panel 14 may be varied from the inner edge 46.

It is envisaged that the length of the collapsible boat hull 10 of the present invention could vary from about 2 m to 8 m in length.

The shape of the side and bottom panels 12, 14 are adapted such that when the collapsible boat hull 10 is in the erected configuration, the side panels 12 bend inwardly and the bottom panels 14 bend upwardly such that the stem of the boat hull 10 is raised above the stem of the boat hull 10, as in a conventional small boat hull. Accordingly, the collapsible boat hull 10 handles very well in the water when it is in the erected configuration.

Figure 4:
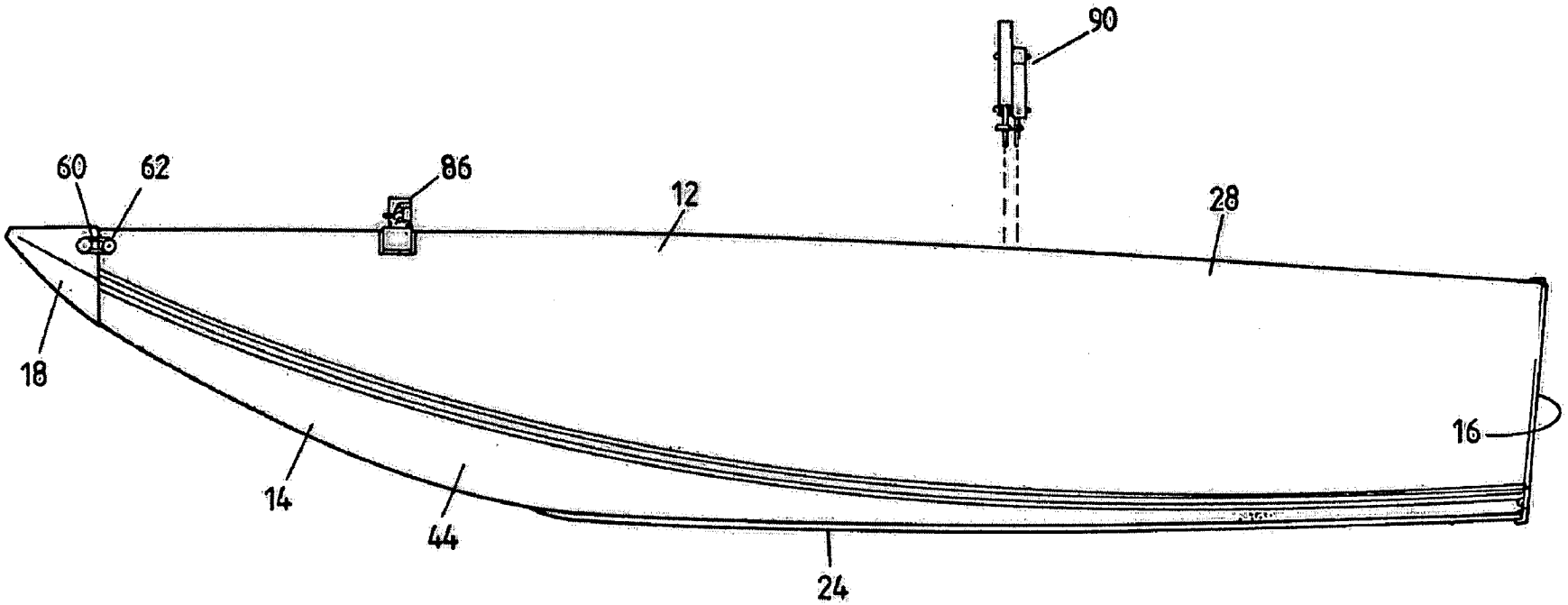
FIG. 4 is a side elevation view of the collapsible boat hull of FIG. 1.
Figure 5:
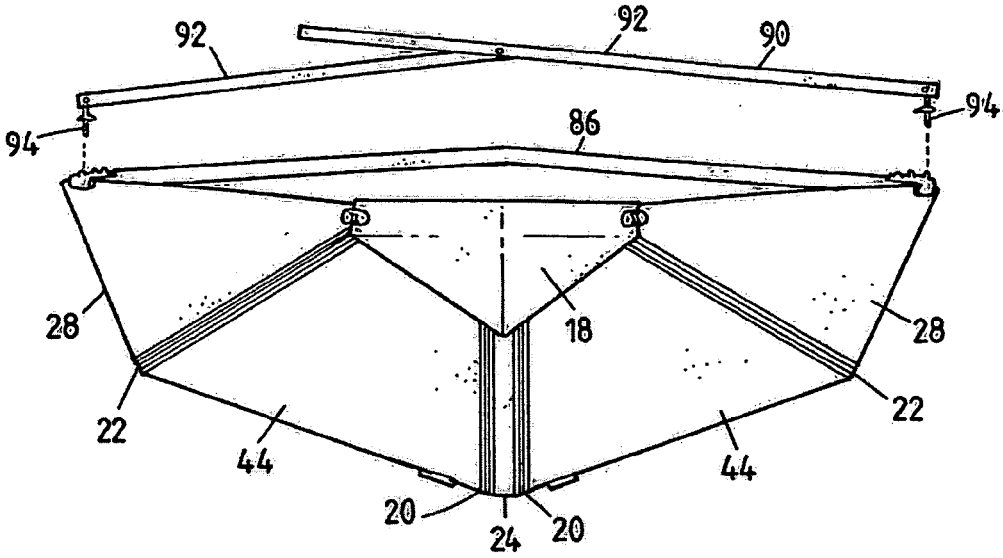
FIG. 5 is a front elevation view of the collapsible boat hull of FIG. 1.
Figure 6:
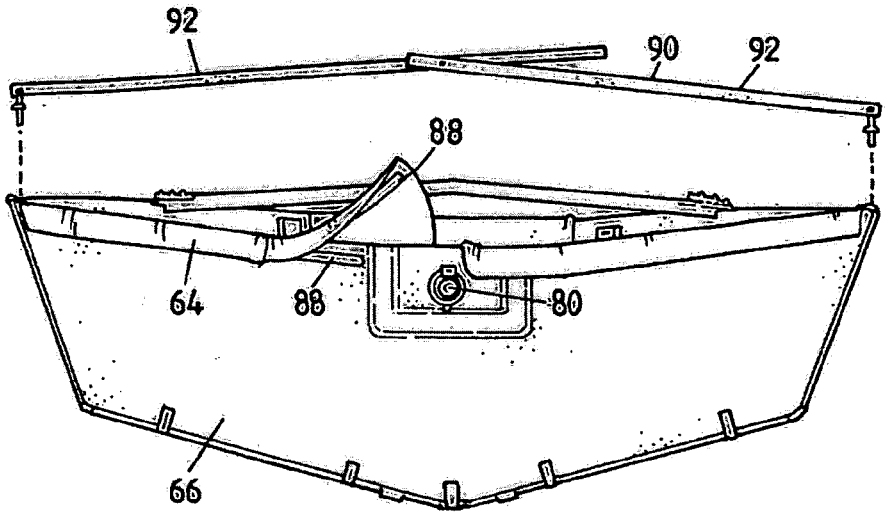
FIG. 6 is a rear elevation view of the collapsible boat of FIG. 1.

The side and bottom panels 12, 14 are shaped such that as the boat hull 10 is opened from its folded configuration, each side panel 12 provides a tensile force to its corresponding bottom panel 14 and vice versa. This tensile force causes portions of the bottom panels 14 from about the mid-ship line 1 to the aft edges 46 thereof to be directed upwardly in a continuous curve, as shown in FIG. 4, and respective portions of the side panels 12 from about the mid-ship line 1 to the aft edge 34 thereof to form a concave curvature to define the sides of the boat hull 10. In this way, the boat hull 10 is afforded a conventional shape, rather than the flat-bottomed hull or variations of cathedral designs and gull wing designs generally available in prior art collapsible boat hulls.

The bottom panels 14 are interconnected to the opposing sides of the keel member 24 along the whole length of the bottom panels' 14 inner edges 42 by the pair of first continuous hinges 20. The wings of the first continuous hinges 20 are fastened to the outer surface 44 of the bottom panels 14 and the opposing sides of the keel member 24 by suitable fastening means such as rivets or screws, together with an adhesive/sealant.

The outer edge 48 of each bottom panel 14 is interconnected along its whole length to the inner edge 32 of a corresponding side panel 12 by a second continuous hinge 22. The wings of each second continuous hinge 22 are fastened to respective outer surfaces 44, 28 of corresponding bottom and side panels 14, 12 with suitable fastening means such as rivets or screws, together with an adhesive/sealant.

The first and second continuous hinges 20, 22 are made from a plastics material, the spines thereof being typically a plasticised membrane of a co-polymer material and the wings thereof being typically a PVC material which provide a water-tight seal along the length of each of the first and second continuous hinges 20, 22.

The bow member 18 is shaped to substantially cap a space defined by the fore edges 36, 52 of the side and bottom panels 12, 14 and the keel member 24 when the boat hull 10 is in the erected configuration. The bow member 18 is generally rigid and can be formed as an integral member from a mouldable material such as fibreglass or suitable plastics material. Alternatively, it can be formed as a frame covered with waterproof fabric membranes, such as canvas, sailcloth, or nylon fabrics (e.g., ripstop nylon).

The bow member 18 can be provided with a sealing means to provide a waterproof seal between the bow member 18 and the fore edges 36, 54 of the side and bottom panels 12, 14 and the keel member 24 when the bow member 18 is capped therearound.

Generally, the bow member 18 is releasably fastened to the boat hull 10 by means of resilient tensioning straps 60 or clips secured to receiving means 62 provided on an outer surface 28 of the side panels 12.

The stern member 16 is shaped to substantially fit a space defined by the aft edges 34, 50 of the side and bottom panels 12, 14 and the keel member 24 when the boat hull 10 is in the erected configuration. In a preferred embodiment of the invention, the stem member 16 comprises a membrane 64 which provides a waterproof seal across the aft edges 34, 50 of the side and bottom panels 12, 14, and a removable, rigid transom member 66 which locates outside the membrane 64 when the boat hull 10 is in the erected configuration.

The membrane 64 is preferably constructed of strong, flexible or semi rigid materials such as vinyl or suitable plastics such as polypropylene.

The transom member 66 may be shaped and adapted for mounting of short or long shaft outboard motors thereon in accordance with well known principles.

The stem member 16 further includes a removable supporting member 68 located internally of the membrane 64. Each of the side panels 12 includes a guide 70 located adjacent the aft edge 34. The supporting member is held, in use, between the guides 70 and the membrane 64 and provides additional rigidity and protection to the membrane 64.

The boat hull 10 is provided with a detachable rigid V-shaped seat 72 disposed adjacent to the stem member 16 when the boat hull 10 is in the erected configuration, with an apex 74 of the V-shaped seat 72 is rearwardly disposed relative to respective free ends 76 of the V-shaped seat 72. The free ends 76 of the V-shaped seat member 72 are engaged, in use, by locking members 78 located on the inner surfaces 26 of the side panels 12. Preferably, the locking members 78 are spring loaded, and cooperate with catches adjacent the free ends 76 of the V-shaped seat 72 when the V-shaped seat 72 is in a desired location.

The angle of the apex 74 is preferably about 120°, although may range from an acute angle through to a straight seat (i.e., an angle of 180°). Accordingly, the length of the V-shaped seat 72 will vary according to the angle of the apex such that the free ends 76 of the V-shaped seat 72 can be engaged to respective side panels 12 of the boat hull 10.

The apex 74 of the V-shaped seat 72 can be spaced as much as 30% of the length of the boat hull 10 from the stem member 16. Alternatively, the apex 74 can be integral with the stem member 16. Typically, the apex 74 is provided with a rearwardly extending longitudinal strut 80 provided with suitable fastening means to facilitate interconnecting the stem member 16 and the apex 74 of the V-shaped seat 72.

Accordingly, the V-shaped seat 72 acts as a brace to readily transfer the force and vibration of an outboard motor, when the outboard motor is mounted on the stem member 16, to the side panels 12 of the boat hull 10. In this way, an outboard motor of greater than four horsepower can be readily mounted on the stem member 16 and used to its full capacity without destabilising the transom member 66, affecting the integrity of the boat hull 10, or substantially diminishing the quality of handling of the boat hull 10 in the water.

The V-shaped seat 72 is typically mounted midway up the side panels 12, but may be positioned anywhere between a location within about 20% of the inner edge 32 and a location adjacent a gunwale line of the boat hull 10.

Advantageously, the V-shaped seat 72 has an ergonomic design that affords more efficient use of available space in the boat hull 10.

The boat hull 10 is also provided with a detachable second seat 82 comprising an elongate member transversely disposed between the side panels 12 when the boat hull 10 is in the erected configuration. The second seat 82 is generally positioned substantially on a mid-ship line 1 of the boat hull 10, but it may be positioned at a location at or between about 20% of the length of the boat hull 10 fore or aft of the mid-ship line 1. The second seat 82 is typically mounted midway up the side panels 12, but may be positioned anywhere between a location within about 20% of the inner edge 32 and a location adjacent a gunwale line of the boat hull 10

Outer ends of the second seat 82 are engaged, in use, by locking members 84 located on the inner surfaces 26 of the side panels 12. Preferably, the locking members 84 are spring loaded, and cooperate with catches adjacent the outer ends of the second seat 82 when the V-shaped seat 72 is in a desired location.

Typically the transom member 66, the V-shaped seat 72 and the second seat 80 can be made from a rigid lightweight material including, but not limited to, composite materials, fibreglass, aluminium, plywood, rigid PVC, and rigid plastics materials.

Although in the preferred embodiment of the invention the V-shaped seat 72 and the second seat 82 are engaged by locking members 78, 84, the invention envisages other fastening means which may be used. Suitable fastening means include, but are not limited to, latches and barrel bolts, stainless steel or metallic alloy male/female receptors, self latching/locking devices, and known locking devices that can be manually or automatically operated.

The collapsible boat hull 10 further includes a V-shaped forward bar 86 which fastens at opposed ends thereof to gunwale edges 30 between the fore edges 58 and the second seat 82. The forward bar 86 can support a flexible spray deck if desired.

The collapsible boat hull 10 may optionally be provided with detachable clamp-on rollicks disposed on the gunwale line, and/or a detachable fore deck formed from flexible materials, such as mesh, vinyl, sail cloth or plastics materials to conveniently hold life jackets, safety equipment, fishing equipment, and the like.

Alternatively, the collapsible boat hull may have a rigid foredeck, constructed of material such as fibreglass, alloy, plywood or plastics. The rigid foredeck may be removable, and is preferably foldable for easing stowing.

In the collapsed and folded state, the bottom and side panels 14, 12 are substantially disposed contiguously upon one another as shown in FIG. 2. In the collapsed and folded state, the bottom and side panels 14, 12 may be readily inserted into a carrier bag shaped to accommodate the collapsed and folded boat hull 10, and transported on or in a marine or land vehicle.

In use, from the collapsed and folded state, the bottom and side panels 14, 12 and the keel member 24 can be readily opened and assembled to the open configuration. In order to assist with this operation, a separating member 90 may be employed.

The separating member 90 comprises two elongate members 92 hingedly connected, with pins 94 extending laterally from outer ends thereof. The pins 94 are sized to located within corresponding apertures 96 in the gunwale edges 30. A downward force applied to one of the elongate members 92 causes the pins 94 to move apart, thus forcing the side panels 12 into their erected configuration.

The bow member 18 is then capped around the space defined by the fore edges 36, 52 of the side and bottom panels 12, 14 and the keel member 24, and secured therearound by securing tensioning straps 60 from the bow member 18 around receiving means 62, or alternately by the use of latches.

The transom member 66 is also fitted into the space defined by the aft edges 34, 50 of the side and bottom panels 12, 14 and the keel member 24, outside the membrane 66. The membrane 66 may be looped over the transom member 66 and secured by releasable means such as hook and loop fasteners 88.

Guide means may be used to facilitate attachment of the second seat 82 and the V-shaped seat 72 to the side panels 12 and the transom member 16 respectively by engaging the fastening means provided for that purpose.

Once these members, together with the forward bar 86, are in place the separating member 90 may be removed.

Optionally, once the boat hull 10 is erected the outboard motor may also be mounted on the stem member 16.

Advantageously, the ready erection of the boat hull 10 in its erected configuration can be achieved in most locations, including shallow water.

Modifications and variations as would be apparent to a skilled addressee are deemed to be within the scope of the present invention.

What is clamed is:

1. A collapsible boat hull comprising:

a pair of bottom panels, each bottom panel having a first continuous hinge along an inner edge thereof and a second continuous hinge along an outer edge thereof; and a pair of side panels, each side panel being connected to an adjacent bottom panel along a respective second continuous hinge, wherein the first and second continuous hinges each have resilient flexibility along respective longitudinal and transverse planes thereof, thereby facilitating the bottom and side panels to be moved between a folded configuration and an erected configuration, whereby in the erected configuration each side panel and its adjacent bottom panel provide a tensile force to each other through their respective second continuous hinge, the tensile force causing portions of the panels to form a concave curvature to define the sides of the boat hull.

2. A collapsible boat hull as claimed in claim 1, wherein each of the bottom panels and side panels is substantially flat and contiguous when the boat hull is in the folded configuration.

3. A collapsible boat hull as claimed in claim 2, wherein each bottom panel bends upwardly and each side panel bends inwardly when the boat hull is moved between the folded configuration and the erected configuration.

4. A collapsible boat hull as claimed in claim 3, wherein, when each side panel is flat each side panel has:

a gunwale edge which defines a first continuous convex curve; and an inner edge opposed to the gunwale edge which defines a second continuous convex curve.

5. A collapsible boat hull as claimed in claim 4, wherein a descent of the first continuous curve becomes steeper from about a mid-ship line to a fore edge of the side panel, and a descent of the second continuous curve becomes steeper from about a mid-ship line to a fore edge of the side panel, the descent of the second continuous curve being greater than that of the first continuous convex curve.

6. A collapsible boat hull as claimed in claim 5, wherein, when each bottom panel is flat, each bottom panel has:

an inner edge, a portion of which defines a third continuous convex curve; and an outer edge opposed to the inner edge which defines a fourth continuous convex curve.

7. A collapsible boat hull as claimed in claim 6, wherein the third continuous curve extends between a fore edge of the bottom panel and about the mid-ship line.

8. A collapsible boat hull as claimed in claim 1, wherein the boat hull includes a stern member comprising a waterproof membrane and a removable, rigid transom member.

9. A collapsible boat hull as claimed in claim 8, wherein the membrane is located internally of the removable transom member.

10. A collapsible boat hull as claimed in claim 9, wherein the stern member further includes a removable supporting member located internally of the membrane.

11. A collapsible boat hull as claimed in claim 8, wherein the stern member is subject to a compressive force exerted by the boat panels.

12. A collapsible boat hull as claimed in claim 1, wherein the boat hull includes a removable bow member.

13. A collapsible boat hull as claimed in claim 12, wherein the bow member is shaped as a cap.

14. A collapsible boat hull as claimed in claim 1, wherein the boat hull includes a V-shaped forward bar which attaches to gunwale edges of opposed side panels and is spaced apart from the bottom panels.

15. A collapsible boat hull as claimed in claim 14, wherein the V-shaped forward bar is subject to a compressive force exerted by the side panels.

16. A collapsible boat hull as claimed in claim 1, wherein the boat hull includes a rigid foredeck.

17. A collapsible boat hull as claimed in claim 1, wherein each bottom panel is connected by its first continuous hinge to a keel member.

18. A collapsible boat hull as claimed in claim 1, wherein the two bottom panels are directly connected by a single first continuous hinge.

19. A collapsible boat hull as claimed in claim 1, wherein the first and second continuous hinges respectively have first and second spines, the first and second spines having resilient flexibility.

20. A collapsible boat hull as is claimed in claim 1, wherein the boat hull includes a transverse forward bar which attaches to gunwale edges of the side panels spaced-apart from the bottom panels.

21. A collapsible boat hull as is claimed in claim 1, wherein the boat hull includes a hinged separating member coupled to the side panels so that, upon application of force to the separating member, the separating member causes the side panels to move away from each other.

22. A collapsible boat hull as claimed in claim 1, wherein the boat hull includes at least one seat extending between the side panels, the seat being subjected to a compressive force exerted by the side panels.

23. A collapsible boat hull comprising:

a pair of bottom panels, each bottom panel having a first continuous hinge along an inner edge thereof and a second continuous hinge along an outer edge thereof;

a pair of side panels, each aide panel being connected to an adjacent bottom panel along a respective second continuous hinge;

a stern member; and a V-shaped seat, the seat providing a brace between the stern member and the side panels and having an apex having an angle about 120°.

24. A collapsible boat hull as claimed in claim 23, wherein the seat is arranged to transfer force and vibration from an outboard motor mounted on the stern member to the side panels.

25. A method of erecting a collapsible boat, the method including:

providing a boat comprising a pair of bottom panels, each bottom panel having a first continuous hinge along an inner edge thereof and a second continuous hinge along an outer edge thereof, and a pair of side panels, each side panel being connected to an adjacent bottom panel along a respective second continuous hinge;

providing a separating member, the separating member comprising two pins arranged to locate in apertures of the side panels, the two pins being arranged to move apart upon the application of a force;

locating the pins in the apertures; and applying a force to the separating member to cause the two side panels to move away from each other.

* * * * *